US010024115B1

(12) United States Patent
Bollman et al.

(10) Patent No.: US 10,024,115 B1
(45) Date of Patent: Jul. 17, 2018

(54) AUGER CLEANING APPARATUS

(71) Applicants: Jimmy Bollman, Oklahoma City, OK (US); Wayne M Darce, Jr., Edmond, OK (US); Jeffrey McLaughlin, Edmond, OK (US)

(72) Inventors: Jimmy Bollman, Oklahoma City, OK (US); Wayne M Darce, Jr., Edmond, OK (US); Jeffrey McLaughlin, Edmond, OK (US)

( * ) Notice: Subject to any disclaimer, the term of this patent is extended or adjusted under 35 U.S.C. 154(b) by 0 days.

(21) Appl. No.: 15/731,632

(22) Filed: Jul. 11, 2017

(51) Int. Cl.
*E21B 12/06* (2006.01)
*E21B 10/44* (2006.01)
*B08B 1/04* (2006.01)

(52) U.S. Cl.
CPC ..... *E21B 12/06* (2013.01); *B08B 1/04* (2013.01); *E21B 10/44* (2013.01)

(58) Field of Classification Search
CPC ..... E21B 12/06; B08B 1/04
See application file for complete search history.

(56) References Cited

U.S. PATENT DOCUMENTS 3,581,833 A 6/1971 Hennecke
3,968,846 A 7/1976 Brenner
4,364,441 A 12/1982 Geeting
4,650,012 A 3/1987 Bollinger
5,242,027 A 9/1993 Blum
5,655,610 A 8/1997 Skinner
6,189,681 B1 2/2001 England
6,749,032 B2 6/2004 Snyder, Sr.
7,614,463 B1 11/2009 Hunziker
7,849,938 B1 12/2010 Maier
2015/0176337 A1* 6/2015 Ditillo ..... E02F 3/083 175/57

* cited by examiner

*Primary Examiner* — D. Andrews
*Assistant Examiner* — Dany E Akakpo
(74) *Attorney, Agent, or Firm* — Randal D. Hoburg

(57) ABSTRACT

An auger cleaning apparatus for the removal of debris and drilling substrate from the helical blades of an auger, the apparatus comprising two half-cylinder sections attaching by a hinge which encircle the outer perimeter of the auger, the two half cylinders forming a full cylinder, with at least one scraper directed to an inner cavity within the full cylinder, each scraper fitting within the voids between the threaded helical blade, scraping the debris and drilling substrate from the auger blade, each scraper extending between the spaces within the helical auger blade expelling the removed debris from the inner cavity through a respective evacuation port outside of the auger cleaning apparatus.

3 Claims, 6 Drawing Sheets

AUGER CLEANING APPARATUS

CROSS REFERENCE TO RELATED APPLICATIONS

None.

I. BACKGROUND OF THE INVENTION

1. Field of Invention

An auger cleaning apparatus for the removal of debris and drilling substrate from the helical blades of an auger, the apparatus comprising two half-cylinder sections attaching by a hinge which encircle the outer perimeter of the auger, the two half cylinders forming a full cylinder, with at least one scraper directed to an inner cavity within the full cylinder, each scraper fitting within the voids between the threaded helical blade, scraping the debris and drilling substrate from the auger blade, each scraper extending between the spaces within the helical auger blade expelling the removed debris from the inner cavity through a respective evacuation port outside of the auger cleaning apparatus.

2. Description of Prior Art

A preliminary review of prior art patents was conducted by the applicant which reveal prior art patents in a similar field or having similar use. However, the prior art inventions do not disclose the same or similar elements as the present auger cleaning apparatus, nor do they present the material components in a manner contemplated or anticipated in the prior art.

Prior art discloses two main categories of auger cleaning tools in the prior art. The first category provides for a fixed cutting blade which requires the tool to be raised and lowered in a vertical direction to scrap a surface of the rotating helical blade. These fixed blade devices include U.S. Pat. No. 5,655,610 to Skinner, U.S. Pat. No. 7,614,463 to Hunziker, U.S. Pat. No. 4,650,012 to Bollinger and U.S. Pat. No. 7,849,938 to Maier. The other category includes a horizontally rotating auger scraper tool which is mounted on a pivotal or vertical tracking device that provides a blade with a vertically rotating blade, three examples in the shape of a daisy flywheel, including U.S. Pat. No. 6,749,032 to Snyder, Sr., U.S. Pat. No. 5,242,027 to Blum and U.S. Pat. No. 3,968,846 to Brenner, and one depicting rotating flaps indicated in U.S. Pat. No. 6,189,681 to England.

These prior art device do not indicate a cylinder having two hinged half-cylinders encircling an auger with a blade directed inward, the blade fitted within the space between the helical auger blade to remove debris and drilling materials from the space all the way to the auger shaft nor a locking means to lock the two half-cylinders together during the debris cleaning of the auger.

II. SUMMARY OF THE INVENTION

Rotating augers are used to drill holes in the earth (threaded drill), as drive shafts to enact linear action of other components within a machine (worm drive mechanisms) and also to transfer materials from one point to another (grain augers used in agriculture). During the operation of the auger, grime and debris can build upon on the auger. For purposes of reference within this application, the auger will be referenced as having the following basic components including but not limited to a shaft, an attaching end, a tool end, a continuous helical blade, and an upper and lower blade surface. A "space" is defined between the upper surface of a lower blade segment and the lower surface of a next higher blade segment. This space is where the debris and/or drilling materials are transported and sometimes "stuck" within the auger. The basic operation of the present auger cleaning apparatus is to remove the debris and/or drilling materials from this defined space.

III. DESCRIPTION OF THE DRAWINGS

The following drawings are submitted with this utility patent application.

FIG. 6 is a side view of the auger cleaning apparatus in a closed position.

IV. DESCRIPTION OF THE PREFERRED EMBODIMENT

Figure 1:
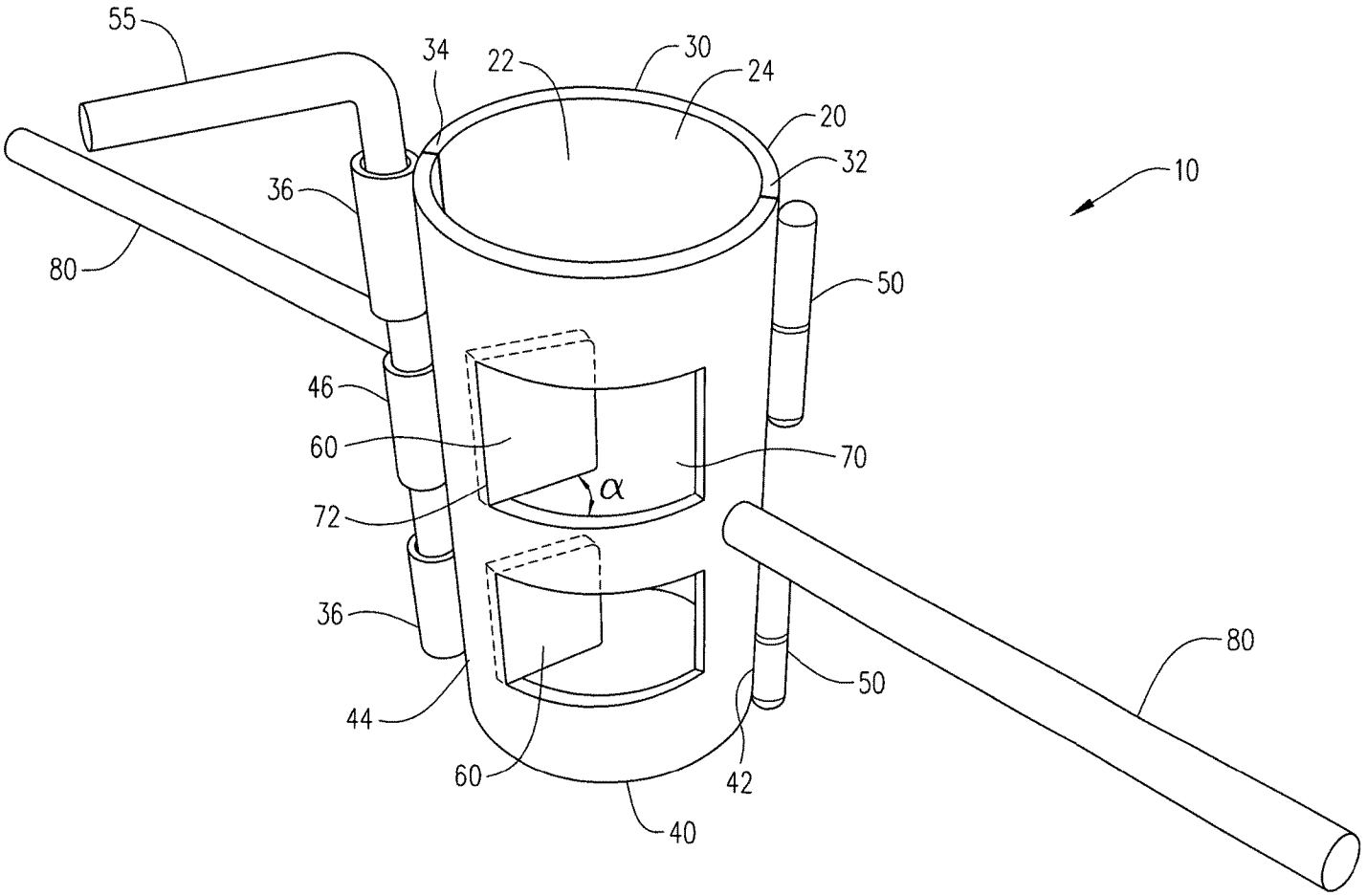
FIG. 1 is an perspective view of the auger cleaning apparatus in a closed position.
Figure 2:
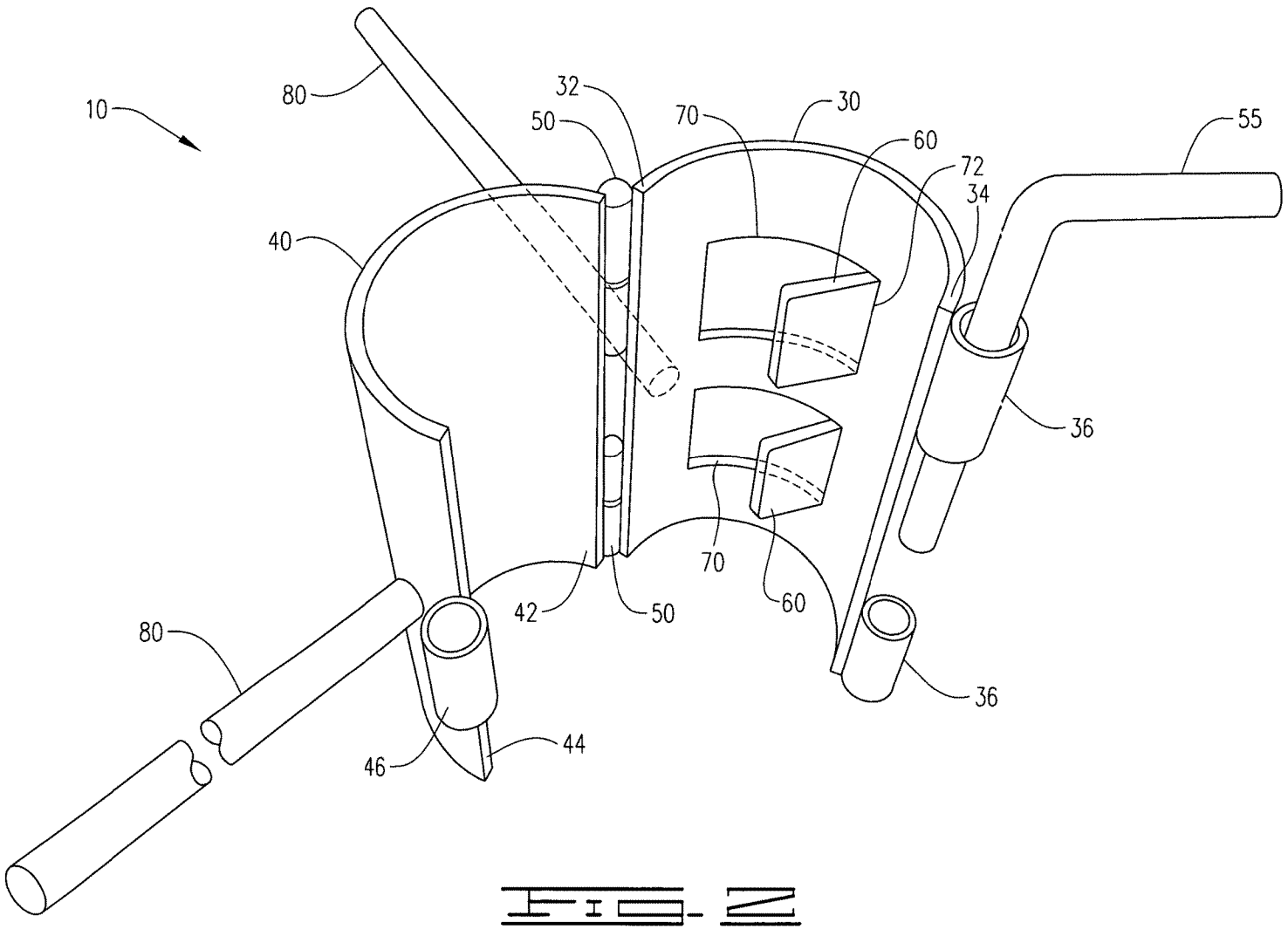
FIG. 2 is an upper perspective view of the auger cleaning apparatus in an open position.

An auger cleaning apparatus 10 for the cleaning of an auger 100 defining a shaft 102 and a helical blade 104 used for digging a hole in the ground, the auger cleaning apparatus 10, shown in FIGS. 1-7 of the drawing figures, comprising a cylindrical clamshell assembly 20 formed by a first half cylinder 30 and second half cylinder 40 joined together by a pair of hinges 50, the clamshell assembly 20 defining an inner cylindrical cavity 22 having an internal diameter 24 larger than an outer diameter 105 of the auger 100. Each first and second half cylinder 20, 30 defines a respective hinge side 32, 42 and a lock side 34, 44, each lock side 34, 44 further extending at least one lock sleeve member 36, 46. The clamshell assembly 20 provides an open position, as indicted in FIGS. 2, 5 and 7, wherein the auger cleaning apparatus 10 is open prior to installation upon the auger 100, and a closed position, indicated in FIGS. 1, 3 and 6, at which time a common locking pin 55 engages the aligned lock sleeve members 36, 46 of each closed half cylinder 20, 30, locking the clamshell assembly 20 together to secure the clamshell assembly 20 around the auger 100 during use of the auger cleaning apparatus 10 to clean the debris from the helical blade 104 of the auger 100, FIG. 1.

To perform the cleaning of the suitable auger 100, at least one half cylinder 30, 40 includes at least one internally directed scraper 60, angled inward from the at least one half cylinder 30, 40 into the cylindrical cavity 22. This scraper 60 attaches to a lateral edge 72 of an evacuation port 70, shown in FIGS. 1-2 and 6-7, as a rectangular evacuation port, within the at least one half cylinder 30, 40. The orientation, as previously stated, directs the at least one internally directed scraper 60 at an acute angle α to the evacuation port 70, FIG. 3, within the inner cavity 22, the angle α determined between the scraper 60 and the inner diameter 24 of the clamshell assembly 20. When th auger 100 is engaged within the auger cleaning apparatus 10, each at least one internally directed scraper 60 extends between the helical blade 104 in a space, with each scraper 60 directed toward the auger shaft 102, FIGS. 3 and 7, with the at least one rectangular evacuation port 70 discharging debris removed from the auger 100 to the outside of the cylindrical clamshell 20 assembly as the auger cleaning device 10 is rotated along the length of the auger 100.

Figure 3:
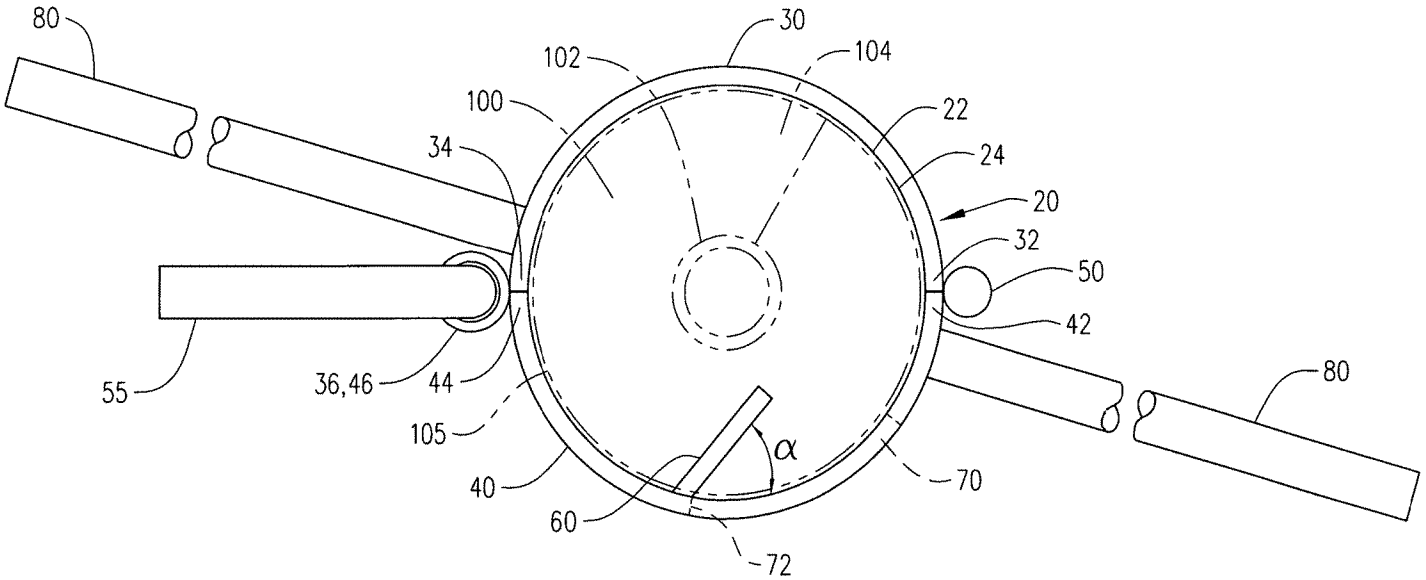
FIG. 3 is an upper view of the auger cleaning apparatus in a closed position with phantom lines indicating an auger within the apparatus during debridement of the auger.

Laterally extending handles 80 are attached to each half cylinder 30, 40, as best indicated in FIGS. 1, 3 and 6, which are used to provide manually applied rotational torque to the auger cleaning apparatus 10 during the cleaning process. The auger cleaning apparatus 10 is rotated causing the at least one internally directed scraper 60 to sweep, scrape and remove the debris off of the helical blade 104 of the auger 100. This cleaning is conducted along the entire length of the auger. Once concluded, the auger cleaning apparatus 10 is removed from the auger 100, either at the bottom of the auger, or at any location along the length of the auger by simply removing the locking pin 50 and opening the clamshell assembly 20 to release the auger 100 from the auger cleaning apparatus 10.

Figure 4B:
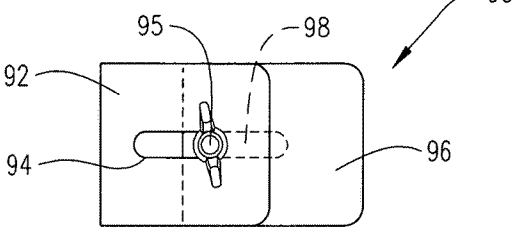
FIGS. 4A and 4B are isolated views of an adjustable depth blade extending within the internal cylindrical cavity for adjusting the cleaning depth of the apparatus.
Figure 4A:
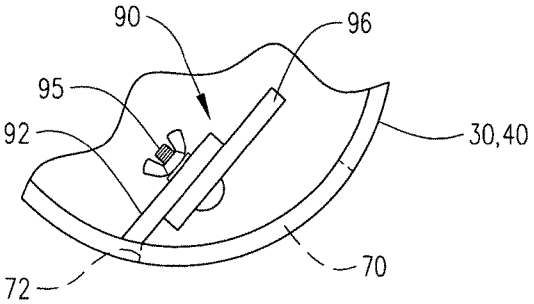
Figure 5:
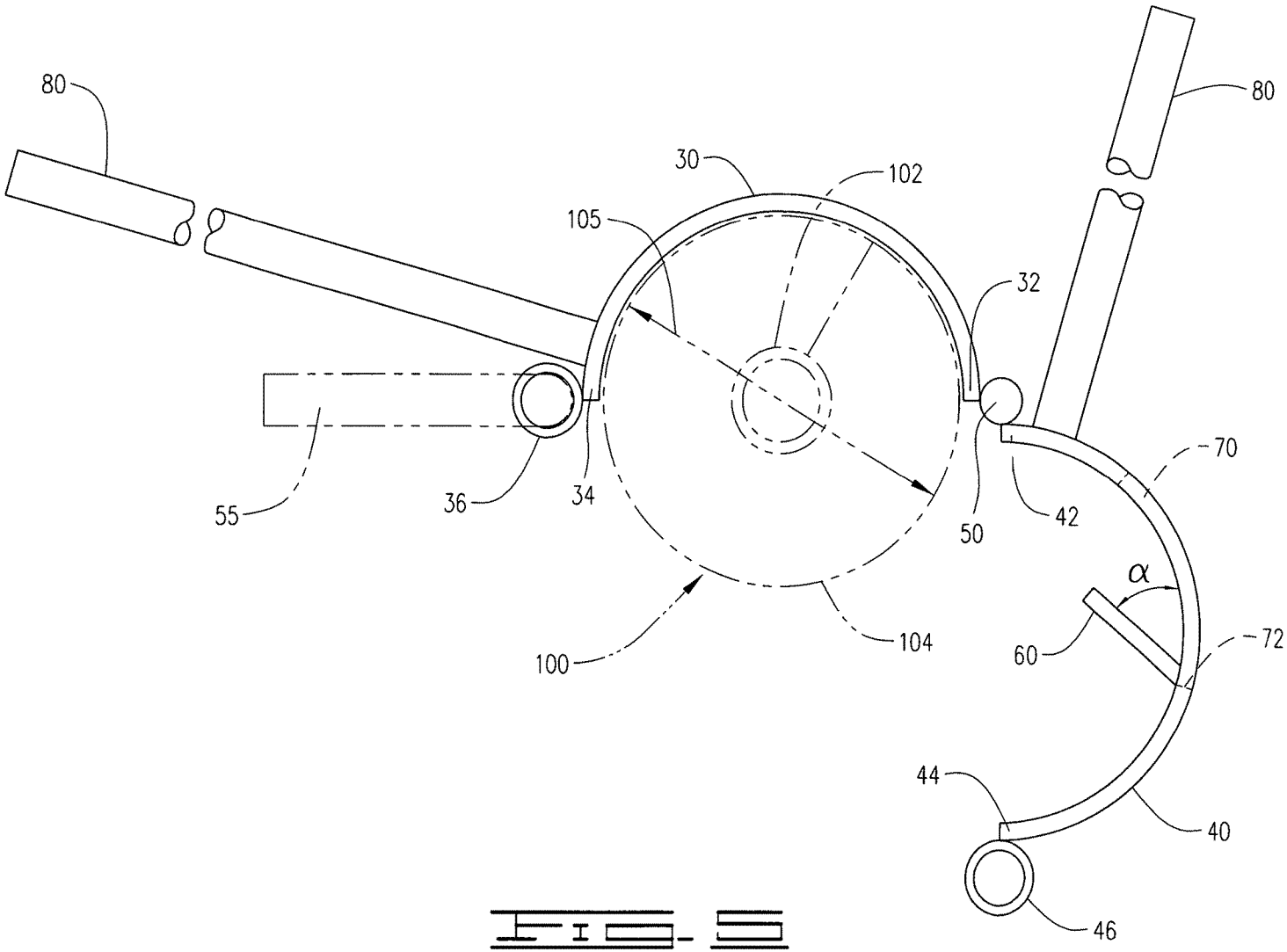
FIG. 5 is an upper view of the auger cleaning apparatus in an open position with phantom lines indicating an auger within the apparatus with another phantom line indicating the placement of the locking pin.
Figure 5:
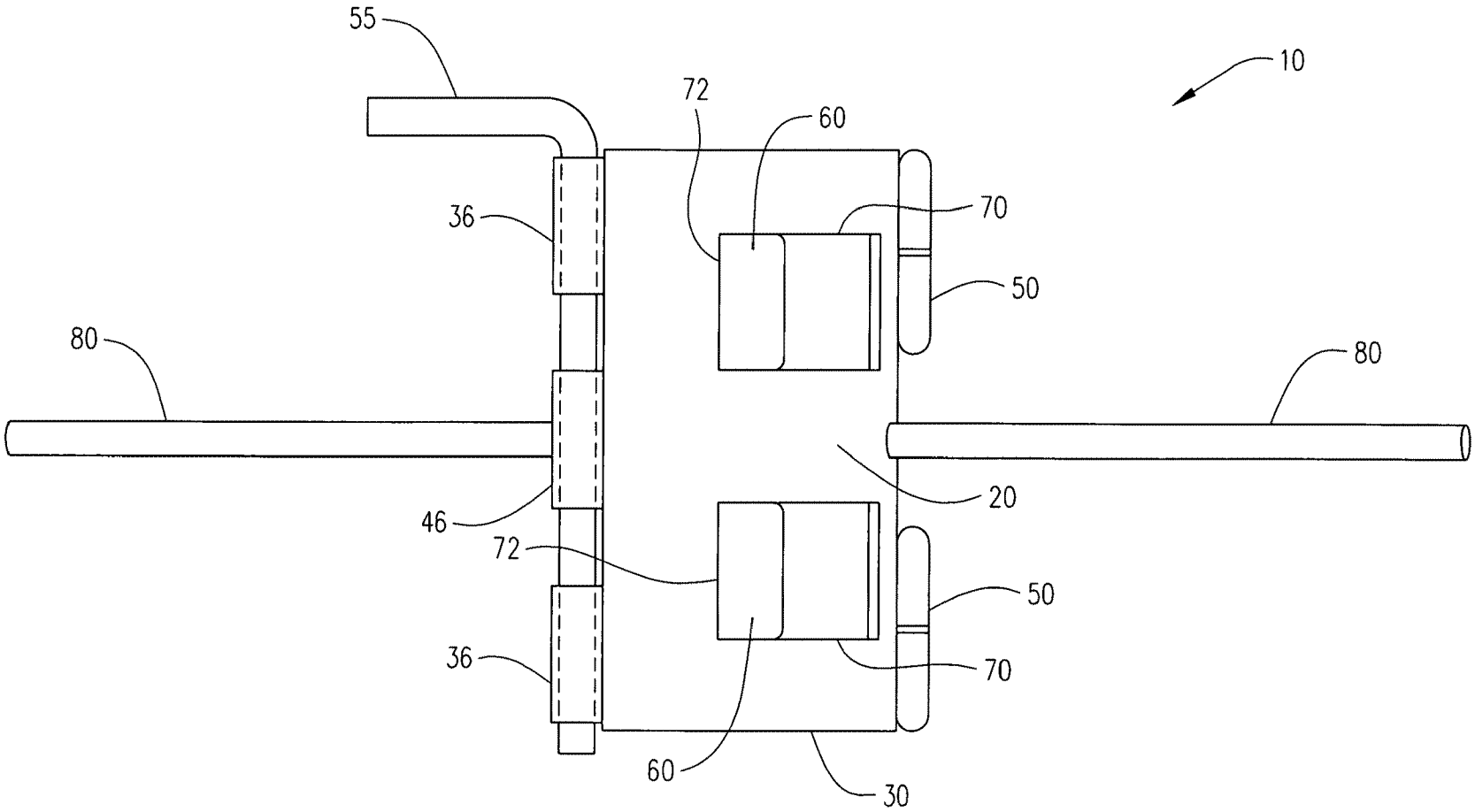
Figure 7:
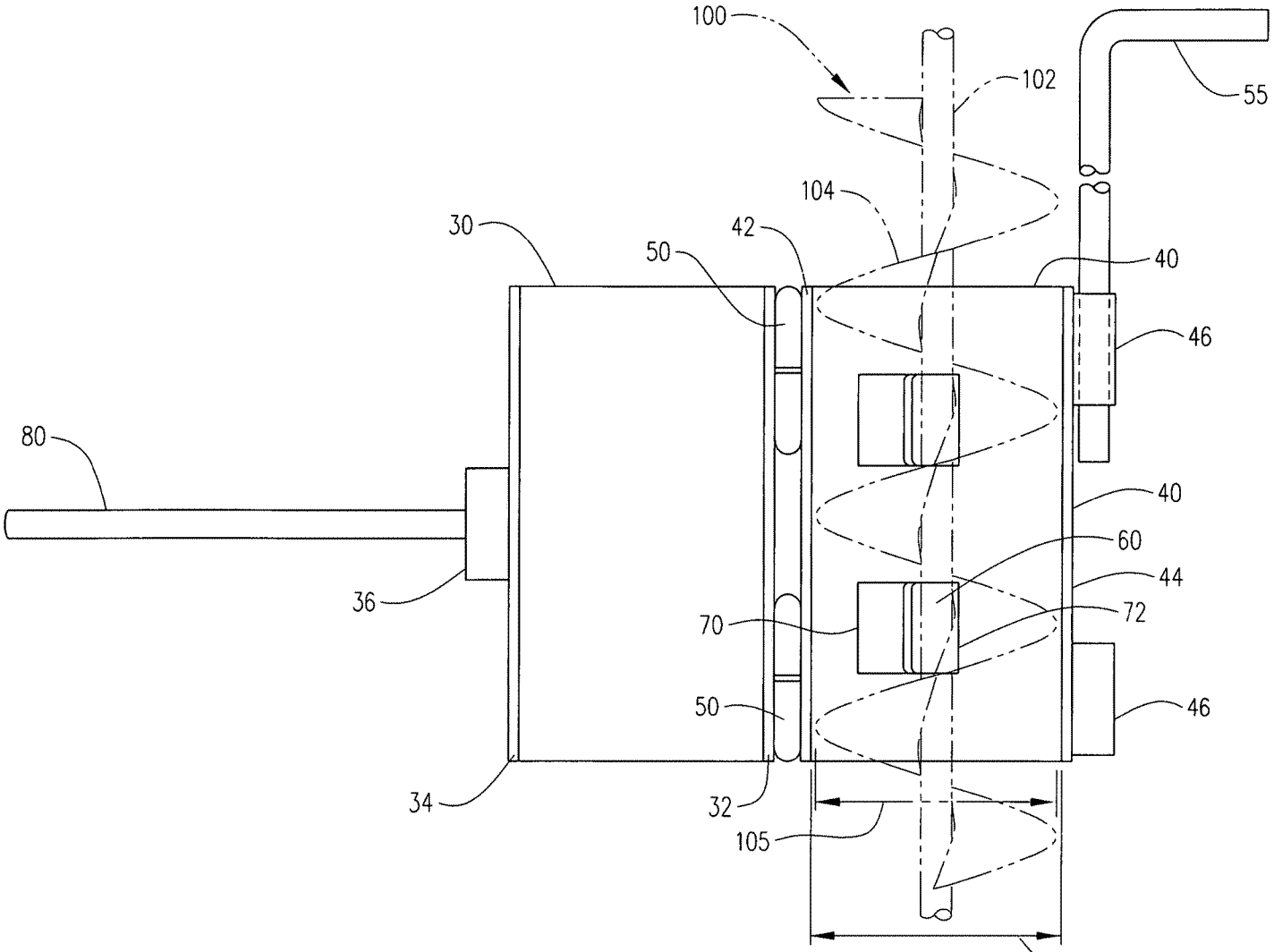
FIG. 7 is a side view of the auger cleaning apparatus in an open position indicating the auger, shown in phantom lines, placed within a half cylinder of the clamshell cylinder assembly.

There are at least two contemplated embodiments of the at least one internally directed scraper 60. First, there is a fixed scraper 60, shown in FIGS. 1-3 and 5-7 and as previously discussed in detail. An adjustable depth scraper 90, shown in FIGS. 4A and 4B as a second embodiment, is a sectional component comprising a fixed portion 92, attached to the lateral edge 72 of the evacuation port 70, and an extending portion 96, the extending portion 96 adjustably attached to the fixed portion 92 by a locking member 95. In FIGS. 4A and 4B, the locking member 95 is a nut and bolt and secures the fixed portion to the extending portion along aligned respective linear grooves 94, 98 in each respective fixed portion 92 and extending portion 96 forming the adjustable depth scraper 90. It is contemplated that the auger cleaning apparatus 10 may include at least one fixed scraper 60, at least one adjustable depth scraper 90, or one or more of each fixed and adjustable scrapers 60, 90, in combination. The shape of the scraper 60 is shown as an overall squared extension. However, it is contemplated that the scraper 60 may be shape in several contours including a parallelogram, a rectangle, and rounded edge extension, an angled extension, a triangular extension, and also that the presenting margin of the scraper having a dull edge or a sharpened edge, not shown.

The size and inner diameter of each auger cleaning apparatus 10 is manufactured in various s sizes, depending upon the size and outer diameter 105 of the auger 100 to which the auger cleaning apparatus is applied, with each component of the auger cleaning device 10 proportional to the applied auger size. The material construction of the auger cleaning apparatus 10 would preferable be a strong metal with the scrapers 60 being a hardened steel.

The contemplated solution addressed by the present auger cleaning apparatus 10 appears when the augers 100 become clogged with wet soil and mud, rock particles, sticky clay, and sometimes chemically saturated debris. Using the prior devices, the cleaning apparatus 10 appears to be either perpetual or conducted by the use of complex machinery. Most often, in the absence of any auger cleaning device, the average farmer or construction person would resort to the use of a hammer and chisel, a screwdriver, a hand held scraper, or whatever was handy, to manually remove the debris from the auger. Using the present apparatus, the easy application of the auger cleaning apparatus 10 is presented at any location along the auger 100, and a few spins of the auger cleaning apparatus removes a majority of the debris without any more manual exertion than the application of rotational torque to the applied auger cleaning apparatus 10.

While the auger cleaning apparatus 10 has been particularly shown and described with reference to a preferred embodiment thereof, it will be understood by those skilled in the art that changes in form and detail may be made therein without departing from the spirit and scope of the invention.

What is claimed is:

1. An auger cleaning apparatus to remove debris from an auger, said auger defining a shaft and a helical blade used for digging a hole in the ground, said auger cleaning apparatus comprising:

a cylindrical clamshell assembly formed by a first half cylinder and second half cylinder joined together by a pair of hinges, said clamshell assembly defining an inner cylindrical cavity having an internal diameter larger than an outer diameter of said auger, each said first and second half cylinder respectively defining a hinge side and a lock side, wherein said pair of hinges provides an open position and a closed position for said clamshell assembly;

at least one lock sleeve member attached to each said lock side of each said first and second half cylinder with a common locking pin to secure said lock sleeve members together in said closed position;

at least one internally directed scraper angled inward from at least one half cylinder into said cylindrical cavity of said clamshell assembly, said scraper attaching to a lateral edge of at least one evacuation port within said at least one half cylinder, wherein said auger is placed within said inner cylindrical cavity with said at least one said scraper directed towards said shaft of said auger between said helical blade of said auger, said auger cleaning apparatus configured to be rotated along said auger with said at least one scraper removing debris from said auger through said at least one evacuation port until said auger is clean; and at least one lateral extending handle attached to at least one half cylinder to provide manual torque to rotate said auger cleaning apparatus about said auger.

2. The auger cleaning apparatus of claim 1, further comprising:

said scraper is a fixed scraper directed within said inner cylindrical cavity at an acute angle to said evacuation port, said acute angle determined by the angle defined between said inner diameter of said clamshell assembly and said fixed scraper.

3. The auger cleaning apparatus of claim 1, further comprising:

said scraper is an adjustable depth scraper defining a fixed portion attached to said lateral edge of said evacuation port, said fixed portion defining a linear groove and an extending portion, defining a linear groove, adjustably attached to said fixed portion, with a locking member securing said extending portion to said fixed portion at a selected length through said respective linear grooves, said adjustable depth scraper directed within said inner cylindrical cavity at an acute angle to said evacuation port, said acute angle determined by the angle defined between said inner diameter of said clamshell assembly and said fixed portion of said adjustable depth scraper.

* * * * *